US011364402B1

(12) United States Patent
Sorrentino

(10) Patent No.: US 11,364,402 B1
(45) Date of Patent: Jun. 21, 2022

(54) ABDOMINAL RESISTANCE DEVICE

(71) Applicant: Claudio Sorrentino Living Trust, Boca Raton, FL (US)

(72) Inventor: Claudio Sorrentino, Boca Raton, FL (US)

(73) Assignee: Claudio Sorrentino Living Trust, Boca Raton, FL (US)

( * ) Notice: Subject to any disclaimer, the term of this patent is extended or adjusted under 35 U.S.C. 154(b) by 0 days.

(21) Appl. No.: 17/507,140

(22) Filed: Oct. 21, 2021

(51) Int. Cl.

| | |
|---|---|
| ***A63B 22/06*** | (2006.01) |
| ***A63B 21/055*** | (2006.01) |
| ***A63B 69/16*** | (2006.01) |
| ***A63B 21/00*** | (2006.01) |
| ***A63B 21/04*** | (2006.01) |
| *A63B 21/02* | (2006.01) |
| *A63B 23/02* | (2006.01) |

(52) U.S. Cl.
CPC ..... *A63B 21/00185* (2013.01); *A63B 21/04* (2013.01); *A63B 21/0552* (2013.01); *A63B 21/4005* (2015.10); *A63B 21/4009* (2015.10); *A63B 21/4025* (2015.10); *A63B 22/0605* (2013.01); *A63B 69/16* (2013.01); *A63B 21/02* (2013.01); *A63B 23/0222* (2013.01)

(58) Field of Classification Search
CPC ..... A63B 21/00185; A63B 21/4005; A63B 21/4009; A63B 21/00058; A63B 21/00061; A63B 21/02; A63B 21/023; A63B 21/025; A63B 21/04; A63B 21/0442; A63B 21/045; A63B 21/055; A63B 21/0552; A63B 21/0557; A63B 21/1609; A63B 21/4007; A63B 21/4024; A63B 21/4025; A63B 22/0605; A63B 22/06; A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 23/0222; A63B 69/16; A63B 2069/161; A63B 2069/162; A63B 2069/163; A63B 2069/164; A63B 2069/165; A63B 2069/166; A63B 2069/167; A63B 2069/168
See application file for complete search history.

(56) References Cited

U.S. PATENT DOCUMENTS

| | | | | |
|---|---|---|---|---|
| 2008/0119333 | A1* | 5/2008 | Bowser | A63B 21/156 482/62 |
| 2011/0245043 | A1* | 10/2011 | Mitchell | A63B 23/1209 482/62 |
| 2013/0029809 | A1* | 1/2013 | Spevak | A63B 23/0211 482/63 |
| 2013/0150216 | A1* | 6/2013 | Bell | A63B 23/0222 482/72 |
| 2020/0324163 | A1* | 10/2020 | Berry | A63B 21/0056 |
| 2021/0339067 | A1* | 11/2021 | Sims, Jr. | A63B 21/0557 |

* cited by examiner

*Primary Examiner* — Megan Anderson
(74) *Attorney, Agent, or Firm* — Christopher & Weisberg, P.A.

(57) ABSTRACT

A cycling system includes a cycle having a frame with a resistance element attachment point, a resistance element, and a harness. The harness is releasably secured to the resistance element attachment point by the resistance element.

14 Claims, 5 Drawing Sheets

ABDOMINAL RESISTANCE DEVICE

CROSS-REFERENCE TO RELATED APPLICATION n/a

FIELD

The present technology is generally related to a device and system for abdominal resistance training during spinning, cycling, and related methods thereof.

BACKGROUND

Spinning and/or cycling is a healthy, low-impact form of exercise that allows individuals to ride a mobile or stationary cycle or bicycle by either remaining seated or standing up out of the seat or saddle when pedaling. Many individuals cycle as a way of controlling or reducing body weight, as well as raising their metabolic rate, building muscle, and burning body fat. Cycling is primarily an aerobic activity which primarily provides stress on the rider's heart, blood vessels, and lungs, and allows riders to readily adjust the time and intensity of the exercise to suit their particular needs.

SUMMARY

The techniques of this disclosure generally relate to a device and system for abdominal resistance training during spinning or cycling, and related methods thereof.

In one embodiment, the present disclosure provides a cycling system. The cycling system includes a cycle having a frame with a resistance element attachment point, a resistance element, and a harness. The harness is releasably secured to the resistance element attachment point by the resistance element.

In one aspect of this embodiment, the resistance element is formed of an elastic material capable of returning substantially to at least one of an original length and an original shape after being stretched.

In one aspect of this embodiment, the resistance element is formed of an elastic material capable of returning substantially to at least one of an original length and an original shape after being stretched.

In one aspect of this embodiment, the resistance element has a first end and a second end opposite the first end, the first and second ends each including a retaining mechanism.

In one aspect of this embodiment, the first end of the resistance element is releasably affixed to a distal end of the resistance element attachment point and the second end of the resistance element is releasably affixed to the harness.

In one aspect of this embodiment, the frame of the cycle has a first end portion, a second end portion opposite the first end portion, and a longitudinal axis defined therebetween, the resistance element attachment point being coupled to the second end portion of the frame.

In one aspect of this embodiment, the resistance element attachment point is integrated with the frame of the cycle.

In one aspect of this embodiment, the resistance element attachment point is releasably affixed to the frame of the cycle.

In one aspect of this embodiment, the resistance element attachment point further includes: a rack having a length. The rack includes: a first rack portion and a second rack portion movable with respect to the first rack portion to change the length of the rack.

In one aspect of this embodiment, the rack further includes a shelf configured to be movable with respect to at least one of the first rack portion and the second rack portion.

In one aspect of this embodiment, a greater degree of tension is applied to the resistance element when the length of the rack is increased.

In one aspect of this embodiment, the second rack portion is configured to extend distally away from and remain at least partially received within the first rack portion when the length of the rack is increased.

In another embodiment, a rail has a proximal portion and a distal portion opposite the proximal portion. The proximal portion is coupled to the cycle frame; and a rack is coupled to the rail. The rack has a length.

In one aspect of this embodiment, the rack further includes a first rack portion and a second rack portion movable with respect to the first rack portion to change the length of the rack.

In one aspect of this embodiment, the second rack portion is configured to extend distally away from and remain at least partially received within the first rack portion when the length of the rack is increased.

In yet another embodiment, a method of performing abdominal exercise on a cycle includes mounting a cycle, the cycle being mounted by a cyclist; securing a harness around the cyclist, the harness is coupled to a resistance element attachment point by a resistance element; adjusting a level of tension applied to the resistance element; and pedaling the cycle while the level of tension is being applied to the resistance element.

In one aspect of this embodiment, the resistance element attachment point includes a rack having a length. A greater level of tension is applied to the resistance element by increasing the length of the rack, and a lesser level of tension is applied to the resistance element by decreasing the length of the rack.

In one aspect of this embodiment, the resistance element is formed of an elastic material capable of returning substantially to at least one of an original length and an original shape after being stretched.

In one aspect of this embodiment, the resistance element has a first end and a second end opposite the first end, the first and second ends each including a retaining mechanism.

In one aspect of this embodiment, the first end of the resistance element is releasably affixed to the resistance element attachment point and the second end of the resistance element is releasably affixed to the harness.

In one aspect of this embodiment, the method further includes performing an abdominal crunch while pedaling on the cycle.

The details of one or more aspects of the disclosure are set forth in the accompanying drawings and the description below. Other features, objects, and advantages of the techniques described in this disclosure will be apparent from the description and drawings, and from the claims.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
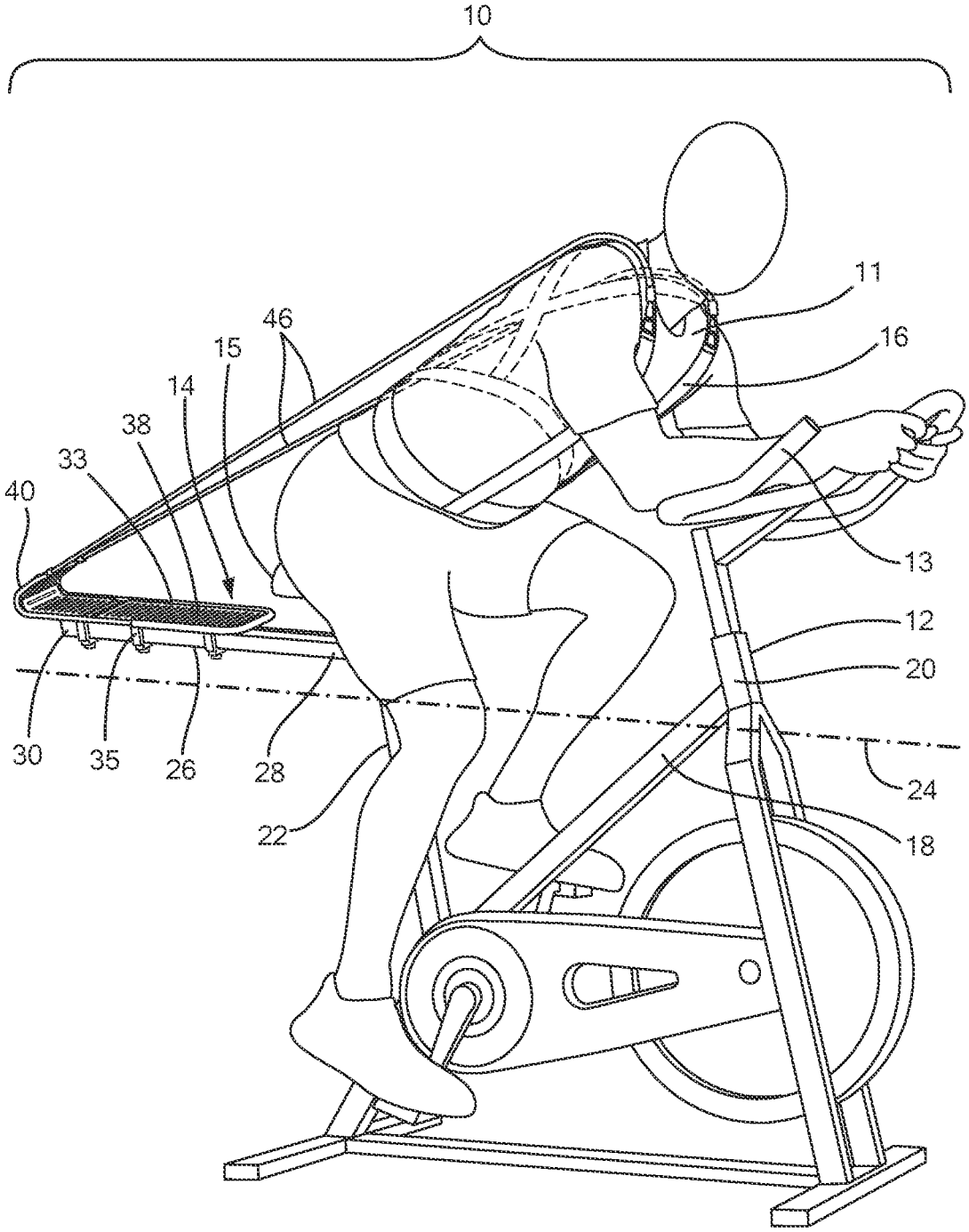
FIG. 1 shows an exemplary system in accordance with the principles of the present application.

Referring now to FIG. 1, in which an exemplary abdominal resistance training system constructed in accordance with the principles of the present application and designated generally as "10" is shown. The system 10 may include a cycle 12 having a set of handlebars 13 and a seat 15. The system 10 further includes a resistance element attachment point 14 attached to the cycle 12, and a harness 16 sized and configured to be worn by a cyclist 11 when riding the cycle 12. The cycle 12 may be, for example, a mobile and/or a stationary cycle or exercise bike (e.g., a spinning bike as shown in FIG. 1) or similar apparatus that allows users or cyclists to engage in physical activity by pedaling in a cyclical motion, and includes a frame 18 having a first end portion 20, a second end portion 22 opposite the first end portion 20, and a longitudinal axis 24 defined therebetween. The set of handlebars 13 are proximate to the first end portion 20, and the seat 15 is proximate to the second end portion 22. As described herein, the term "cycling" may refer to both indoor cycling, such as on a stationary spinning bike, and/or outdoor cycling.

Figure 2:
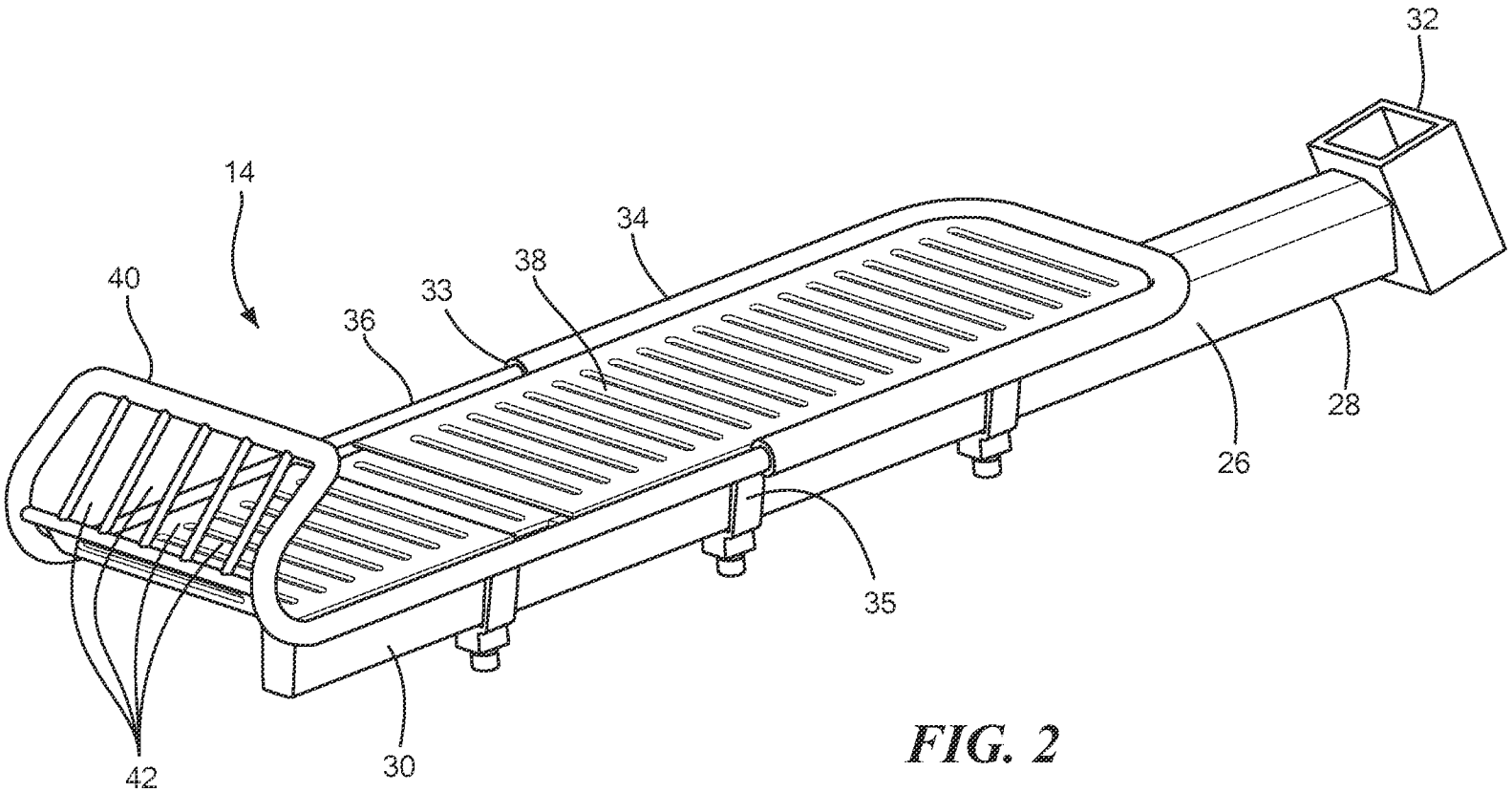
FIG. 2 shows a perspective view of a resistance element attachment point attached to the rear of the cycle.

As shown in FIG. 2, in some configurations, the resistance element attachment point 14 is attached, coupled, or otherwise affixed to the second end portion 22 of the frame 18 and may be composed of a substantially rigid material such as titanium, alloy, steel, iron, or the like. However, in other configurations, the resistance element attachment point 14 may be integrated with the frame 18 of the cycle 12. The resistance element attachment point 14 includes a rail 26 having a proximal portion 28 and a distal portion 30 opposite the proximal portion 28. The proximal portion 28 of the rail 26 includes a clamp 32 that may be releasably secured to the frame 18. The length of the rail 26 defines a longitudinal axis that extends through and between the proximal portion 28 and the distal portion 30, and is coplanar and/or parallel with the longitudinal axis 24 of the frame 18.

The resistance element attachment point 14 further includes a rack 33 secured to, or integrated with, the rail 26. In some configurations, the attachment of the rack 33 to the rail 26 may be facilitated by one or more brackets 35. The rack 33 includes a first rack portion 34 and a second rack portion 36 opposite the first rack portion 34. The first and second rack portions 34, 36, together define a length. The first rack portion 34 is in closer proximity to the seat 15 of the cycle 12 than the second rack portion 36 is. The first rack portion 34 may define a channel (not shown) sized to receive at least a portion of the second rack portion 36 so that the first and second rack portions 34, 36, may be movable longitudinally with respect to one another. For example, the second rack portion 36 is configured to extend distally away from and remain at least partially received within the channel of the first rack portion 34, and thereby changing the overall length of the rack 33. As described in more detail below, the distal extension of the second rack portion 36 allows the cyclist to increase a level of tension or resistance applied to at least one resistance element that is used to secure the harness 16 to the resistance element attachment point 14. When the second rack portion 36 is then retracted or moved towards the first rack portion 34 of the rail 26, the level of tension or resistance may be lessened. In other words, the level of tension applied to each resistance element and the harness 16 may be readily increased or decreased by the cyclist extending the second rack portion 36 away from or towards the first rack portion 34. Additionally, in some configurations, the rack 33 includes an expandable shelf 38 coupled to, mounted on, or otherwise integrated with at least one of the first rack portion 34 and the second rack portion 36. The shelf 38 is expandable longitudinally along the longitudinal axis of the rail 26 based on the movement of the first and/or second rack portions 34, 36. The shelf 38 may define a plurality of slats that allow the shelf 38 to expand when the second rack portion 36 is extended away from the first rack portion 34.

As shown in FIG. 2, a distal end of the second rack portion 36 defines a tail 40 having a curved lateral surface. In one configuration, the tail 40 extends distally away from the rail 26. The tail 40 defines a plurality of openings, channels, or slots 42 that are sized and configured to receive a retaining mechanism 44 from a resistance element 46 (discussed in more detail below) so that the harness 16 may be secured to the tail 40. In one configuration, the retaining mechanism 44 of each resistance element 46 may be a hook, clip, or carabiner attachment, that may be releasably secured to the tail 40 within a respective slot 42 or other portions of the rack 33. The retaining mechanisms 44 may be made of a substantially rigid material such as iron, steel, hard plastic, and the like.

Figure 3:
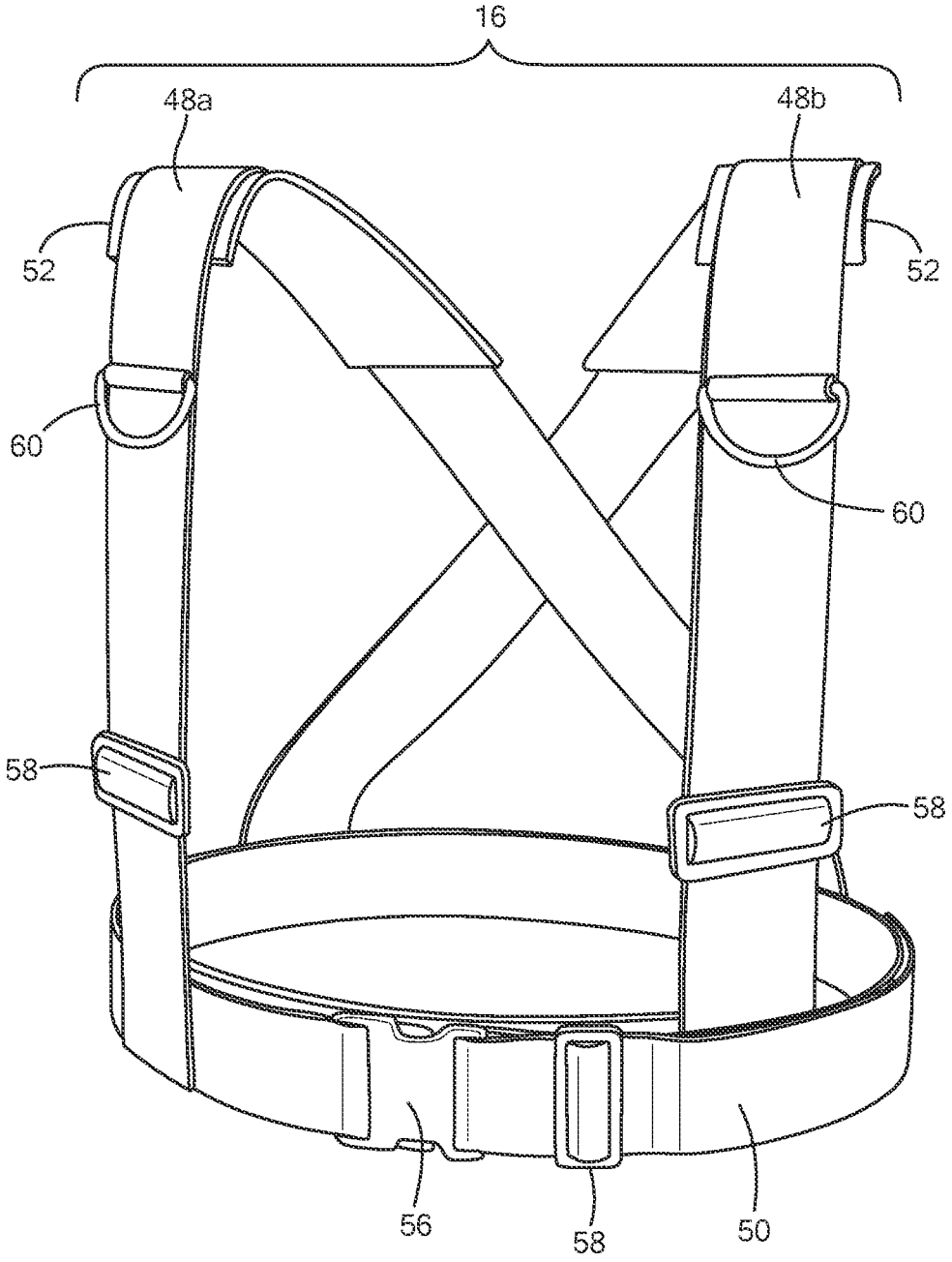
FIG. 3 shows a harness that may be secured to the resistance element attachment point of FIGS. 1-3 by a resistance element.

Now referring to FIG. 3, an exemplary harness 16 for use with the resistance element attachment point 14 is shown. The harness 16 may be made of nylon, plastic, polyester, Kevlar®, Velcro®, and the like and may include a first shoulder strap 48*a*, a second shoulder strap 48*b*, and a waist belt 50 secured to both the first and second shoulder straps 48*a*, 48*b*. Each shoulder strap 48*a*, 48*b* may include a sewn in shoulder pad 52 to provide increased comfort to the cyclist's shoulders and/or torso during use. Similarly, the waist belt 50 may include a sewn in waist pad (not shown) that provides increased comfort and cushioning to the cyclist's abdomen during use. Each of the shoulder straps 48*a*, 48*b*, may be a hook-and-loop type fastener with a sliding adjuster 58 that may be readily tightened or loosened to contour to a cyclist's body type and adjust to a preferred fit. Additionally, and/or alternatively, the waist belt 50, may also include a buckle 56 having a sliding adjuster 58 that allows the user to readily tighten and loosen the fit of the waist belt 50.

Figure 4:
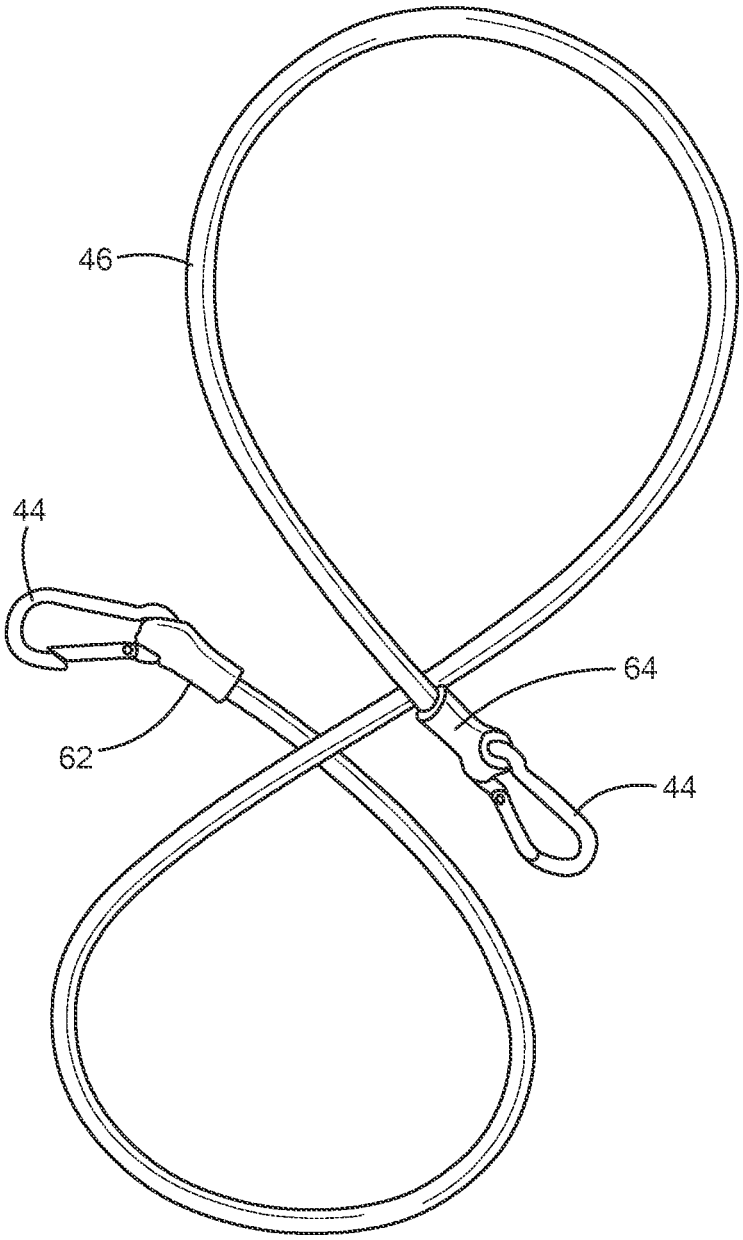
FIG. 4 shows an example resistance element.

As shown in FIG. 3, the harness 16 further includes a plurality of attachment elements 60 that enable the cyclist to releasably affix the harness 16 to the resistance element attachment point 14 prior to mounting the cycle 12, or while mounted on the cycle 12. The harness 16 may be secured to the resistance element attachment point 14 through the use of at least one resistance element 46. As shown in FIG. 4, each resistance element 46 may be an elongate linear, spiral, or coiled tension cable, wire, cord, or element having a first end 62 and a second end 64 opposite the first end 62. The first and second ends 62, 64 may each include the retaining mechanism 44 (i.e., a hook, clip, carabiner attachment, or the like), so that the first and second ends 62, 64, may each couple to the tail 40 and harness 16. It is to be understood that each resistance element 46 is formed of an elastic material capable of returning substantially to at least one of an original length and an original shape after being stretched Referring again to FIG. 1, when the cyclist 11 is wearing the harness 16 and is riding the cycle 12, the cyclist 11 may engage in abdominal resistance training by adjusting a level or degree of tension applied to each resistance element 46 while seated on the seat 15 of the cycle 12. For example, the cyclist 11 may increase the level of tension by slidably extending the second rack portion 36 of the rack 33 distally away from the first rack portion 34 and seat 15 along the longitudinal axis 24 of the cycle frame 18 (i.e., in a rearward direction). In other words, as the second rack portion 36 is extended distally away from the first rack portion 34, each resistance element 46 becomes increasingly stretched and applies a greater level of tension to the cyclist's abdominal muscles and torso as the cyclist is riding.

Additionally, and/or alternatively, the cyclist 11 may engage in or perform an abdominal exercise such as, for example, an abdominal crunch, that causes each resistance element 46 to be stretched further, thereby increasing the degree or level of tension applied to each resistance element 46. As described herein, an abdominal crunch may refer to an exercise in which the cyclist 11 arches their torso forward and down such that the cyclist's shoulders move closer towards the handlebars 13 (and farther from the resistance element attachment point 14), thereby increasing a level of tension or strain applied to the cyclist's abdominal muscles. In some configurations, a first level of tension may be applied to each resistance element 46 when the cyclist is in a first upright position on the cycle 12. The first level of tension may be a lower level of tension such that each resistance element 46 is slack (i.e., does not apply a great amount of resistance force on the harness 16 or cyclist). As the cyclist 11 performs the abdominal exercise, the cyclist's shoulders may move farther away from the resistance element attachment point 14, which causes each resistance element 46 to become increasingly stretched for an interval of time until the cyclist's shoulders return to their original position. Additionally, in addition to performing an abdominal exercise to increase the tension of the resistance elements 46, the cyclist may adjust (increase or decrease) the tension by moving the second rack portion 36 with respect to the first rack portion 34, which changes the length of the rack 33. It is to be understood that the system 10 described herein is not limited to use with abdominal exercises, and thus, may be used together with various other physical exercises as desired by the cyclist.

Figure 5:
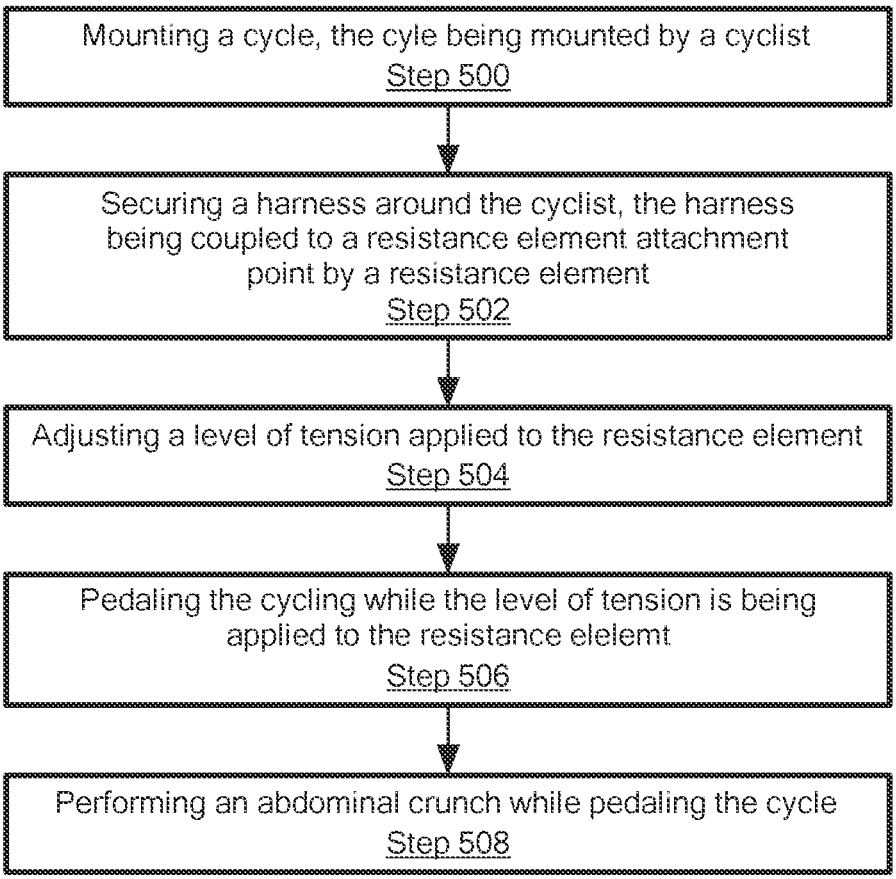
FIG. 5 shows an exemplary method of performing abdominal exercise on a cycle in accordance with the principles of the present application.

Now referring to FIG. 5, in which a flowchart of an example method of performing abdominal exercise on the cycle 12 is shown. As an initial matter, the rider or cyclist 11 may first mount the cycle 12 (Step 500). Once mounted on the cycle 12, the cyclist 11 may then secure the harness 16 around the cyclist's torso and abdomen, and adjust at least one of the first and second shoulder straps 48*a*, 48*b* and the waist belt 50 to the cyclist's preferred fit (Step 502). The harness 16 may be coupled to the resistance element attachment point 14 of the cycle 12 by one or more resistance elements 46. Alternatively, in one embodiment, the cyclist 11 may first securing the harness 16 around the cyclist's torso prior to mounting the cycle 12. Prior to, or during the ride, the cyclist 11 may then readily adjust the tension applied to each resistance element 46 by moving the second rack portion 36 of the rack 33 of the resistance element attachment point 14 longitudinally with respect to the first rack portion 34 (Step 504). The cyclist 11 may increase or decrease the tension applied to the resistance elements 46 at any time during the exercise to vary the amount of stress placed on the cyclist's abdominal muscles and torso. Once the cyclist 11 has set their desired level of tension, the cyclist 11 may then begin to pedal, or continue pedaling the cycle 12 to further their exercise (Step 506). Additionally, in one embodiment, the cyclist 11 may perform an abdominal exercise such as, for example, and abdominal crunch to further increase the level of tension applied to each of the resistance elements 46 as the cyclist 11 is pedaling the cycle 12 or during intermittent intervals of time (Step 508). The cyclist 11 may perform the abdominal exercise at the same time they are pedaling the cycle 12.

It should be understood that various aspects disclosed herein may be combined in different combinations than the combinations specifically presented in the description and accompanying drawings. It should also be understood that, depending on the example, certain acts or events of any of the processes or methods described herein may be performed in a different sequence, may be added, merged, or left out altogether (e.g., all described acts or events may not be necessary to carry out the techniques).

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A cycling system, comprising:

a cycle having a frame with a front end and a rear end;

a seat disposed on the frame between the front end and the rear end;

a resistance element having a first end and a second end; and a harness releasably secured to the first end of the resistance element; and a resistance element attachment point on the frame securing the second end of the resistance element to the frame at one of a plurality of points between the seat and the rear end of the frame.

2. The cycling system of claim 1, wherein the resistance element is formed of an elastic material capable of returning to at least one of an original length and an original shape after being stretched.

3. The cycling system of claim 1, wherein the first and second ends of the resistance element each include a retaining mechanism.

4. The cycling system of claim 1, wherein the resistance element attachment point is integrated with the frame of the cycle.

5. The cycling system of claim 1, wherein the resistance element attachment point is releasably affixed to the frame of the cycle.

6. A cycling system, comprising:

a cycle having a frame with a resistance element attachment point;

a resistance element; and a harness releasably secured to the resistance element attachment point by the resistance element;

wherein the resistance element attachment point is releasably affixed to the frame of the cycle and further includes:

a rack having a length, the rack including:

a first rack portion and a second rack portion movable with respect to the first rack portion to change the length of the rack.

7. The cycling system of claim 6, wherein the rack further includes a shelf configured to be movable with respect to at least one of the first rack portion and the second rack portion.

8. The cycling system of claim 7, wherein a greater degree of tension is applied to the resistance element when the length of the rack is increased.

9. The cycling system of claim 8, wherein:

the second rack portion is configured to extend distally away from and remain at least partially received within the first rack portion when the length of the rack is increased.

10. A method of performing abdominal exercise on a cycle, the method comprising:

mounting a cycle, the cycle being mounted by a cyclist;

securing a harness around the cyclist, the harness being coupled to a resistance element attachment point by a resistance element;

adjusting a level of tension applied to the resistance element; and pedaling the cycle while the level of tension is being applied to the resistance element, wherein the resistance element attachment point includes a rack having a length;

a greater level of tension is applied to the resistance element by increasing the length of the rack; and a lesser level of tension is applied to the resistance element by decreasing the length of the rack.

11. The method of claim 10, wherein the resistance element has a first end and a second end opposite the first end, the first and second ends each including a retaining mechanism.

12. The method of claim 11, wherein the first end of the resistance element is releasably affixed to the resistance element attachment point and the second end of the resistance element is releasably affixed to the harness.

13. The method of claim 10, wherein the resistance element is formed of an elastic material capable of returning to at least one of an original length and an original shape after being stretched.

14. The method of claim 10, further including:

performing an abdominal crunch while pedaling on the cycle.

* * * * *